US010184202B2

(12) United States Patent
Lee et al.

(10) Patent No.: US 10,184,202 B2
(45) Date of Patent: Jan. 22, 2019

(54) WASHING MACHINE, METHOD FOR CONTROLLING WASHING MACHINE, AND COMPUTER READABLE RECORDING MEDIUM

(71) Applicant: SAMSUNG ELECTRONICS CO., LTD., Suwon (KR)

(72) Inventors: Sung-mo Lee, Gunpo (KR); Seung-hun Lee, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 269 days.

(21) Appl. No.: 14/679,416

(22) Filed: Apr. 6, 2015

(65) Prior Publication Data

US 2016/0108575 A1 Apr. 21, 2016

(30) Foreign Application Priority Data

Oct. 17, 2014 (KR) ..... 10-2014-0140888

(51) Int. Cl.
*D06F 37/40* (2006.01)
*D06F 33/02* (2006.01)
*D06F 23/04* (2006.01)

(52) U.S. Cl.
CPC ..... *D06F 37/40* (2013.01); *D06F 23/04* (2013.01); *D06F 33/02* (2013.01); *D06F 2212/00* (2013.01); *D06F 2700/00* (2013.01)

(58) Field of Classification Search
CPC ..... D06F 37/40; D06F 23/04; D06F 33/02; D06F 2212/00; D06F 2700/00
(Continued)

(56) References Cited

U.S. PATENT DOCUMENTS 5,551,261 A 9/1996 Lyu et al.
6,049,930 A 4/2000 Hisano et al.
(Continued)

FOREIGN PATENT DOCUMENTS

EP 2 468 939 A2 6/2012
JP 2000-279692 10/2000
(Continued)

OTHER PUBLICATIONS

Extended European Search Report dated Mar. 22, 2016 in corresponding European Patent Application No. 15185895.8.

*Primary Examiner* — Michael E Barr
*Assistant Examiner* — Tinsae B Ayalew
(74) *Attorney, Agent, or Firm* — Staas & Halsey LLP

(57) ABSTRACT

A washing machine, a method and computer readable recording medium. The washing machine includes a washing spindle and a spin-drying spindle, a coupling that is movable to be engaged with a rotation preventing unit of the washing machine so that power of the driving motor is transferred to the washing spindle but not to the spin-drying spindle, and is movable to a position in which the coupling is not engaged with the rotation preventing unit so that power of the driving motor is transferred to both the washing spindle and the spin-drying spindle, and a control device configured to, in a washing mode of the washing machine, bring the coupling into contact with the rotation preventing unit, cause the coupling to rotate in first and second directions so that the coupling is engaged with the rotation preventing unit, and determine an engagement state by test-operating the driving motor.

2 Claims, 16 Drawing Sheets

(58) Field of Classification Search
USPC ..... 8/159
See application file for complete search history.

(56) References Cited

U.S. PATENT DOCUMENTS

| | | | | |
|---|---|---|---|---|
| 2003/0110575 | A1 | 7/2003 | Lee et al. | |
| 2008/0263784 | A1* | 10/2008 | Cho | D06F 37/304 8/159 |
| 2009/0237014 | A1* | 9/2009 | Yamada | H02P 21/16 318/400.02 |
| 2012/0137738 | A1* | 6/2012 | Lee | D06F 21/08 68/12.24 |
| 2014/0069145 | A1* | 3/2014 | Chupka | D06F 37/40 68/12.24 |

FOREIGN PATENT DOCUMENTS

| | | |
|---|---|---|
| KR | 10-2011-0013062 | 2/2011 |
| KR | 10-2012-0060689 | 6/2012 |

* cited by examiner

| SECTION | | CONTENTS |
|---|---|---|
| ① | MOTOR ALIGNING SECTION | MEASURE INITIAL ANGLE USING HALL SENSOR |
| ② | FORCED DRIVING SECTION (OPEN LOOP CONTROL) | FORCIBLY DRIVE BY OPEN LOOP CONTROL TO VOLTAGE VINIT[V]~VMAX[V] |
| ③ | SPEED CONTROL SECTION (CLOSED LOOP CONTROL) | CONVERT TO SPEED CONTROL AFTER FIVE PULSES ARE GENERATED BY HALL SENSOR |

(a)

(b)

Boxplot of STOP TIME

WASHING MACHINE, METHOD FOR CONTROLLING WASHING MACHINE, AND COMPUTER READABLE RECORDING MEDIUM

CROSS-REFERENCE TO RELATED APPLICATIONS

This application claims priority from Korean Patent Application No. 10-2014-0140888, filed on Oct. 17, 2014 in the Korean Intellectual Property Office, the disclosure of which is incorporated herein by reference in its entirety.

BACKGROUND OF THE INVENTION

1. Field of the Invention

The present general inventive concept generally relates to a washing machine, a method for controlling a washing machine, and a computer readable recording medium, and more particularly, to a washing machine which allows a clutch engagement to be performed normally in a washing mode without using a magnet and a location sensor as in a conventional fully-automatic washing machine which distinguishes a washing mode from a spin-drying mode using a clutch, for example, a method for controlling a washing machine, and a computer readable recording medium.

2. Description of the Related Art

In general, a washing machine tooth-engages a clutch coupling with a water tank or tooth-engages the clutch coupling with a rotor of a driving motor which rotates the pulsator thereby selectively transferring rotation power of the driving motor to a washing spindle or a spin-drying spindle so that the pulsator is rotated separately in a washing mode to perform a washing operation and the pulsator and a spin-drying tub are simultaneously rotated in a spin-drying mode to perform a spin-drying operation.

However, in some cases, the clutch coupling is not correctly tooth-engaged with the water tank or the rotor. When the pulsator or the spin-drying tub is rotated in this situation, tooth forms bump against each other causing a damage of the tooth forms and friction noise.

In order to resolve such problem, in the related art, a washing operation is performed by attaching a magnet to a clutch coupling and attaching a location sensor to a water tank to determine whether a clutch engagement is performed normally.

However, using a magnet and a location sensor as in the related art causes increase of costs.

SUMMARY OF THE INVENTION

The present disclosure has been provided to address the aforementioned and other problems and disadvantages occurring in the related art, and an aspect of the present disclosure provides a washing machine which allows a clutch engagement to be performed normally when a clutch is changed in a washing mode without using a magnet and a location sensor as in a conventional fully-automatic washing machine which distinguishes a washing mode from a spin-drying mode using a clutch, for example, a method for controlling a washing machine, and a computer readable recording medium.

According to an exemplary embodiment, there is provided a washing machine including: a washing spindle and a spin-drying spindle, a coupling that is movable to be engaged with a rotation preventing unit of the washing machine so that power of the driving motor is transferred to the washing spindle but not to the spin-drying spindle, and is movable to a position in which the coupling is not engaged with the rotation preventing unit so that power of the driving motor is transferred to both the washing spindle and the spin-drying spindle, and a control device configured to, in a washing mode of the washing machine, bring the coupling into contact with the rotation preventing unit, cause the coupling to rotate in first and second directions so that the coupling is engaged with the rotation preventing unit, and determine an engagement state by test-operating the driving motor.

The control device may perform an alignment operation of aligning the coupling by bringing the coupling into contact with the rotation preventing unit and applying a first voltage to the driving motor to rotate the coupling right and left at a first speed, and perform a rotation operation of rotating the coupling right and left at a second speed by applying a second voltage to the driving motor after the alignment operation. In addition, the first voltage may be lower than the second voltage, and the first speed may be higher than the second speed.

The control device may test-operate the driving motor at an arbitrary speed and stop the driving motor, compare a stop time with a predetermined threshold time, in response to the stop time being longer than the predetermined threshold time, re-execute an engagement operation of the coupling.

In response to the number of times that the engagement operation is re-executed exceeding a threshold value, the control device may generate an error (PE).

In response to a part where a north (N) polar of the rotor is located being set to be d-axis and a part which is led by 90 degrees being set to be q-axis, the control device may rotate the driving motor by applying a voltage to a stator corresponding to the q-axis so that a magnetic field is formed along the q-axis, and rotate the driving motor right and left at a low speed when performing a washing operation by applying a voltage to a stator corresponding to the d-axis so that a magnetic field is formed along the d-axis, the speed being lower than a speed when a voltage is not applied to the stator corresponding to the d-axis.

The control device may use a three-phase voltage in order to generate a voltage to be applied to the q-axis and the d-axis.

The control device may examine a stop time of the driving motor while a washing operation is performed in the washing mode and controls an engagement operation of the coupling and the rotation preventing unit according to an examination result.

According to an exemplary embodiment, there is provided a washing machine including: a driving device configured to have a coupling to be engaged with a rotor of a driving motor or a rotation preventing unit of a water tank to transfer power of the driving motor to a washing spindle or a spin-drying spindle, and a control device configured to examine a stop time of the driving motor during washing agitation and control an engagement operation of the coupling and the rotation preventing unit based on an examination result.

In response to the stop time exceeding a threshold value and the number of times that the stop time exceeds the threshold value exceeding a predetermined number of times, the control device may determine that the coupling is incorrectly engaged and re-executes an engagement operation.

The control device may convert the washing mode to a spin-drying mode in order to re-execute the engagement operation, change a position of the coupling, and converts the spin-drying mode to the washing mode.

According to an exemplary embodiment, there is provided a control method of a washing machine including a washing spindle, a spin-drying spindle, a driving motor, and a coupling for transferring power of the driving motor to the washing spindle or the spin-drying spindle, the control method including: bringing the coupling into contact with a rotation preventing unit of a water tank and rotating the coupling right and left to engage the coupling to the rotation preventing unit in response to a washing mode starting, determining an engagement state of the coupling and the rotation preventing unit by test-operating the driving motor, and performing a washing operation in response to the coupling being correctly engaged, and re-engaging the coupling with the rotation preventing unit in response to the coupling being incorrectly engaged.

The control method may further include performing an alignment operation of aligning the coupling by bringing the coupling into contact with the rotation preventing unit and applying a first voltage to the driving motor to rotate the coupling right and left at a first speed and performing a rotation operation of rotating the coupling right and left at a second speed by applying a second voltage to the driving motor after the alignment operation. In addition, the first voltage may be lower than the second voltage, and the first speed may be higher than the second speed.

The control method may further include test-operating the driving motor at an arbitrary speed and stopping the driving motor, comparing a stop time with a predetermined threshold time, in response to the stop time being longer than the predetermined threshold time, re-executing an engagement operation of the coupling.

The control method may further include, in response to the number of times that the engagement operation is re-executed exceeding a threshold value, generating an error (PE).

The control method may further include, in response to a part where a north (N) polar of the rotor is located being set to be d-axis and a part which is led by 90 degrees being set to be q-axis, rotating the driving motor by applying a voltage to a stator corresponding to the q-axis so that a magnetic field is formed along the q-axis, and rotating the driving motor right and left at a low speed when performing a washing operation by applying a voltage to a stator corresponding to the d-axis so that a magnetic field is formed along the d-axis, the speed being lower than a speed when a voltage is not applied to the stator corresponding to the d-axis.

The control method may further include using a three-phase voltage in order to generate a voltage to be applied to the q-axis and the d-axis.

The control method may further include examining a stop time of the driving motor while a washing operation is performed in the washing mode and controlling an engagement operation of the coupling and the rotation preventing unit according to an examination result.

According to an exemplary embodiment, there is provided a control method of a washing machine including a driving device configured to have a coupling to be engaged with a rotor of a driving motor or a rotation preventing unit of a water tank to transfer power of the driving motor to a washing spindle or a spin-drying spindle, the control method including: examining a stop time of the driving motor during washing agitation and controlling an engagement operation of the coupling and the rotation preventing unit based on an examination result.

In response to the stop time exceeding a threshold value and the number of times that the stop time exceeds the threshold value exceeding a predetermined number of times, the controlling may include determining that the coupling is incorrectly engaged and re-executing an engagement operation.

The controlling may include converting the washing mode to a spin-drying mode in order to re-execute the engagement operation, changing a position of the coupling, and converting the spin-drying mode to the washing mode.

According to an exemplary embodiment, there is provided a computer readable recording medium having a program for executing a control method of a washing machine comprising a washing spindle, a spin-drying spindle, a driving motor, and a coupling for transferring power of the driving motor to the washing spindle or the spin-drying spindle, the computer readable recording medium executing: bringing the coupling into contact with a rotation preventing unit of a water tank and rotating the coupling right and left to engage the coupling to the rotation preventing unit in response to a washing mode starting, determining an engagement state of the coupling and the rotation preventing unit by test-operating the driving motor, and performing a washing operation in response to the coupling being correctly engaged, and re-engaging the coupling with the rotation preventing unit in response to the coupling being incorrectly engaged.

The computer readable recording medium may further execute performing an alignment operation of aligning the coupling by bringing the coupling into contact with the rotation preventing unit and applying a first voltage to the driving motor to rotate the coupling right and left at a first speed and performing a rotation operation of rotating the coupling right and left at a second speed by applying a second voltage to the driving motor after the alignment operation. In addition, the first voltage may be lower than the second voltage, and the first speed may be higher than the second speed.

The computer readable recording medium may further execute test-operating the driving motor at an arbitrary speed and stopping the driving motor, comparing a stop time with a predetermined threshold time, in response to the stop time being longer than the predetermined threshold time, re-executing an engagement operation of the coupling.

The computer readable recording medium may further execute, in response to a part where a north (N) polar of the rotor is located being set to be d-axis and a part which is led by 90 degrees being set to be q-axis, rotating the driving motor by applying a voltage to a stator corresponding to the q-axis so that a magnetic field is formed along the q-axis, and rotating the driving motor right and left at a low speed when performing a washing operation by applying a voltage to a stator corresponding to the d-axis so that a magnetic field is formed along the d-axis, the speed being lower than a speed when a voltage is not applied to the stator corresponding to the d-axis.

The computer readable recording medium may further execute examining a stop time of the driving motor while a washing operation is performed in the washing mode and controlling an engagement operation of the coupling and the rotation preventing unit according to an examination result.

According to the above described exemplary embodiments, it is possible to reduce manufacturing costs and resolve quality failure due to a damage of a clutch by not using a magnet and a location sensor used in the related art.

BRIEF DESCRIPTION OF THE DRAWINGS

The above and/or other aspects of the present inventive concept will be more apparent by describing certain exemplary embodiments of the present inventive concept with reference to the accompanying drawings, in which.

DETAILED DESCRIPTION OF THE PREFERRED EMBODIMENT

Figure 1:
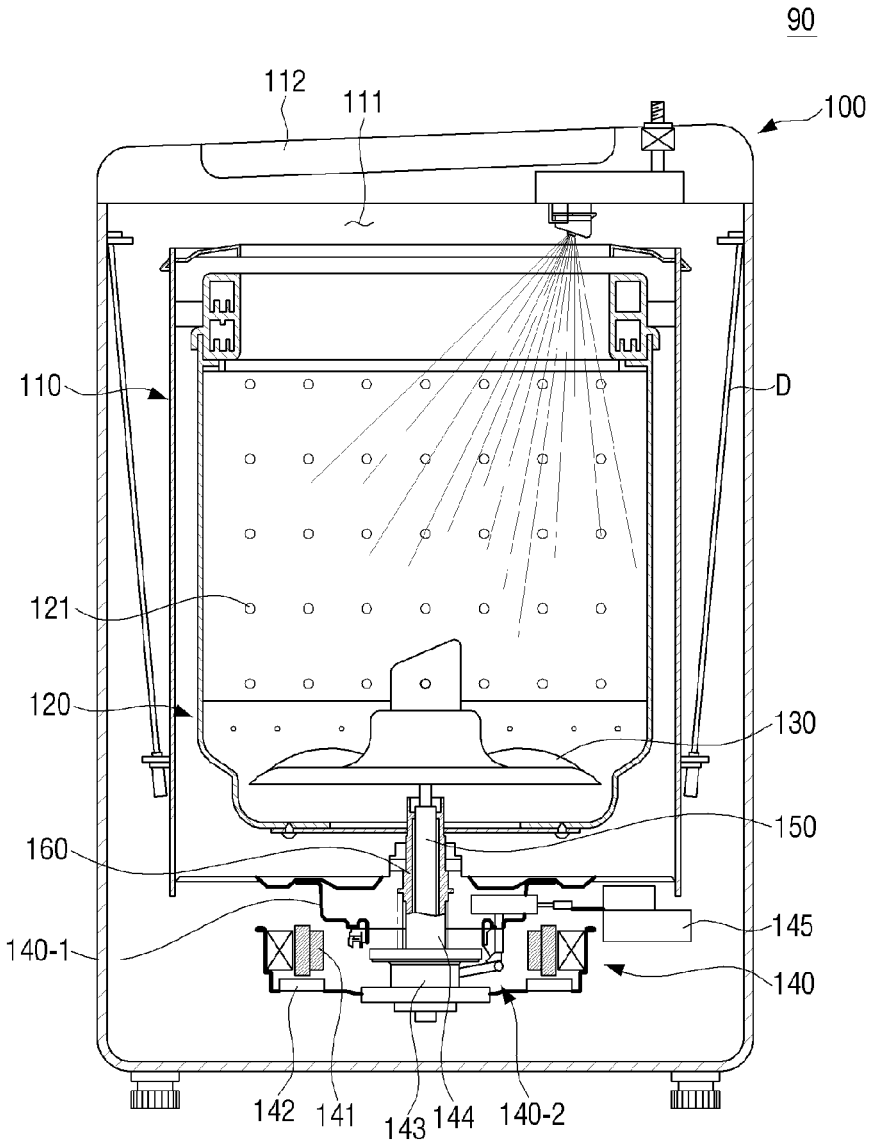
FIG. 1 is a view illustrating an example of a structure of a washing machine including a control device according to an exemplary embodiment.

Certain exemplary embodiments are described in greater detail below with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be practiced without those specifically defined matters. Also, well-known functions or constructions are not described in detail since they would obscure the application with unnecessary detail.

Figure 2:
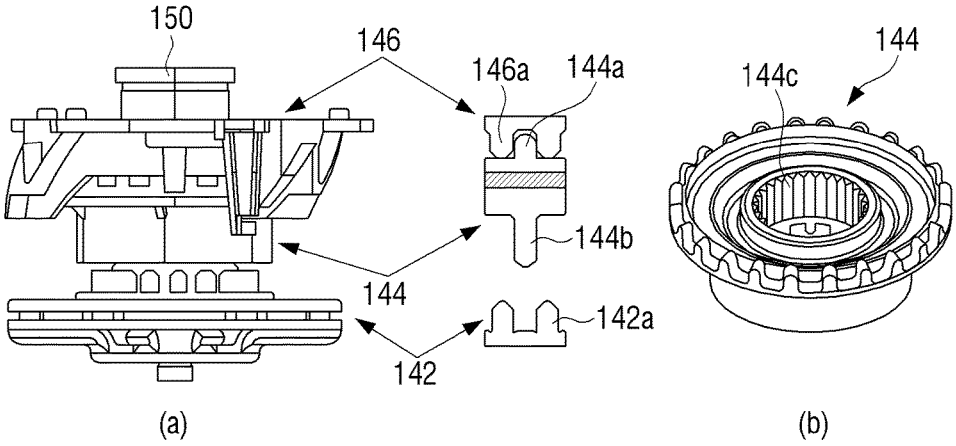
FIG. 2, which includes 2(*a*) and 2(*b*), is a view illustrating an example of a clutch.
Figure 3:
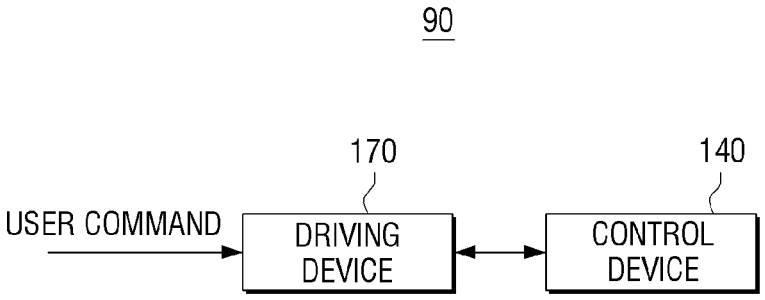
FIG. 3 is a block diagram illustrating an example of a structure of a washing machine according to a first exemplary embodiment.

FIG. 1 is a view illustrating an example of a structure of a washing machine including a control device according to an exemplary embodiment, FIG. 2 is a view illustrating an example of a clutch, and FIG. 3 is a block diagram illustrating an example of a structure of a washing machine according to a first exemplary embodiment.

According to an exemplary embodiment, as illustrated in FIG. 1, a washing machine 90 having a control device includes a main body 100 which forms an appearance of the washing machine, a water tank 110 which is installed inside the main body 100 to hold washing water, a spin-drying tub 120 which is provided to rotate inside the water tank 110, a pulsator 130 which is provided to rotate on a lower part of the spin-drying tub 120, a driving device 140 which drives the spin-drying tub 120 or the pulsator 130, and a control device 170 which controls the driving device 140.

The main body 100 includes a laundry drop 111 which is provided on an upper part of the main body 100 so that laundries are inserted and a cover 112 which is rotatably installed in the main body 100 to open or close the laundry drop 111.

The water tank 110 is supported while being hung up on the main body 100 by a plurality of suspension units (D) which have an open circle-shaped upper part and are engaged with a lower outer surface of the water tank 110. The suspension units (D) reduce vibration which occurs in the main body 100 or the water tank 110 in a washing operation or a spin-drying operation. In addition, a lower part of the water tank 110 may be engaged with a rotation preventing unit 146 of FIG. 2, which forms a clutch. In this case, the rotation preventing unit 146 may constitute a clutch along with a rotor 142 and a coupling 144 which will be described below. Rotation preventing unit 146 may be used to prevent rotation of a spin-drying spindle 160.

The spin-drying tub 120 has an open cylinder-shaped upper part, and a plurality of spin-drying holes 121 are provided around the upper part of the spin-drying tub so that an inside space of the spin-drying tub communicates with an inside space of the water tank 110.

The pulsator 130 generates a water current by rotating in a forward direction or a reverse direction. By the water current, the laundries in the spin-drying tub 120 are agitated with the washing water.

The driving device 140 includes a driving motor 140-1 which receives power and generates a driving power and a power switching device 140-2 which separately transfers the driving power generated by the driving motor 140-1 to the pulsator 130 or simultaneously transfers the driving power to the spin-drying tub 120 and the pulsator 130.

Herein, the driving motor 140-1 may be a BLDC motor which is capable of controlling a rotation speed in various speeds and includes a stator 141 and a rotor 142 which rotates by an electromagnetic interaction with the stator 141. FIG. 2(*a*) illustrates a structure where the rotation preventing unit 146 which forms the clutch, the coupling 144, and the rotor 142 are engaged, and FIG. 2(*b*) is a perspective view of the coupling. The rotor 142 has a hub 143 which is engaged with a washing spindle 150 on a rotation center thereof. The rotor 142 is also disposed on a side of an outer circumference of the driving motor 140-1 and forms a rotating field in a direction of an inner circumference. The hub 143 is axis-engaged with an end of the washing spindle 150. In addition, the hub 143 has a power-transferring tooth unit 142*a* which is engaged with a lower tooth unit 144*b* of the coupling 144 so that the rotation power of the rotor 142 is transferred to the coupling 144.

The power switching device 140-2 includes the coupling 144 which ascends or descends to transfer the driving power of the driving motor 140-1 to the washing spindle 150 or to the washing spindle 150 and the spin-drying spindle 160 and an actuator 145 which generates a driving power so that the coupling 144 ascends or descends. The driving power 145 of the actuator is transferred to a rod (not shown) or a rotatable lever (not shown).

The coupling 144 includes the upper tooth unit 144*a* and the lower tooth unit 144*b* which are respectively installed in an upper part and a lower part and a serration unit 144*c* which is installed on an inner circumference surface. In addition, the coupling 144 slides in a vertical direction between the rotation preventing unit 146 which is fixed on a lower part of the water tank 110 and the rotor 142 of the driving motor 140-1.

The actuator 145 is an electric motor which generates rotation power. In response to the power being applied to the actuator 145, a wire of which one end is connected to the rod and the other end is connected to the actuator 145 is winded, and thus, the rod slides in a direction of the power-switching actuator 145. However, this is merely an example, and the actuator 145 is not limited to an electrical motor which generates the rotation power. The actuator 145 may be realized as a hydraulic cylinder, a linear motor, and the like.

According to the first exemplary embodiment, the control device 170 performs overall operations of the washing machine 90. For example, in response to a user command for executing a washing operation being received, the control device 170 may open a water supply valve in order to start the washing operation, determine a water level, and perform various control operations for driving the pulsator 130. In addition, in a spin-drying mode, the control device 170 may open a water drainage valve in order to start a spin-drying operation and control so that the spin-drying tub 120 and the pulsator 130 are driven.

In the above-described process, when a mode of the washing machine is converted to a washing mode, the control device 170 determines an engagement state of the clutch. That is, in order to correctly engage the coupling 144 with the rotation preventing unit 146 fixed on the lower part of the water tank 110, the control device 170 forcibly rotates the driving motor 140-1 right and left at a low speed using a high voltage. Then, the control device 170 rotates the driving motor 140-1 in a certain direction and measures a stop time in order to determine whether the coupling 144 is correctly engaged with the tooth unit 146*a* of the rotation preventing unit 146. In response to determining that the stop time is in a predetermined time range, the control device 170 determines that the engagement was correctly performed and proceeds with the washing operation. In response to determining that the stop time exceeds the predetermined time range, the control device 170 may execute a re-engagement operation several times. When it is continuously determined that the engagement was not performed correctly, the control device 170 may generate an error (PE) to inform a user of malfunction.

In addition, according to an exemplary embodiment, the control device 170 may assist the clutch engagement by rotating the driving motor 140-1 right and left at a high speed for a short period of time using a voltage which is lower than the above-described high voltage before rotating the driving motor 140-1 right and left at a low speed using the high voltage. Accordingly, the control device 170 may perform a horizontal clutch alignment operation as a preliminary process. The operation of rotating the driving motor 140-1 right and left at a low speed may be referred to as 'low-speed rotation operation' in order to distinguish the operation from the horizontal clutch alignment operation. Executing the low-speed rotation operation along with the horizontal clutch alignment operation may be useful when there is a high washing load. In other words, in response to a low washing load, the clutch may be easily engaged by only one of the horizontal clutch alignment operation or the low-speed rotation operation.

Considering the above, the control device 170 according to the exemplary embodiment may include a low-speed rotation executing unit for rotating the driving motor 140-1 right and left at a low speed, a motion detector which detects a stop after the rotation, and a time measuring unit which compares a stop time with a predetermined value stored in a memory and determines whether the engagement was correctly performed according to a result of measurement. However, this is merely an example, and a part or all of the low-speed rotation executing unit, the motion detector, and the time measuring unit may be integrated as a single body and realized as an algorithm. Accordingly, in the exemplary embodiment, a form of the control device 170 is not particularly limited.

Figure 4:
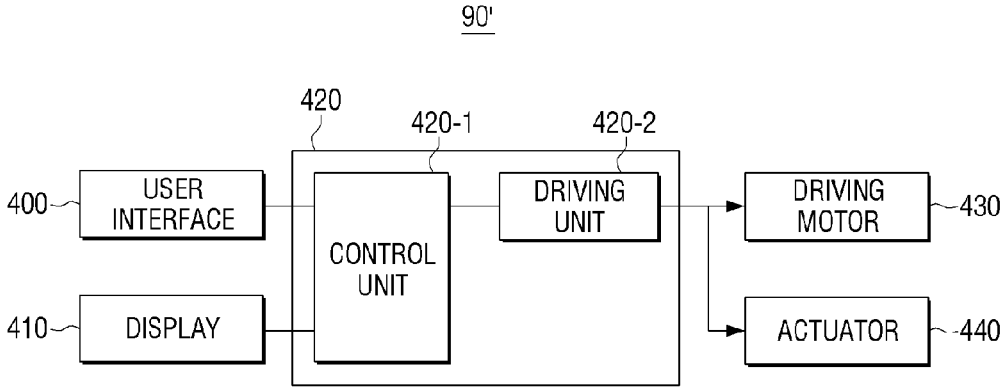
FIG. 4 is a block diagram illustrating an example of a structure of a washing machine according to a second exemplary embodiment.

FIG. 4 is a block diagram illustrating an example of a structure of a washing machine according to a second exemplary embodiment.

Referring to FIG. 4 along with FIG. 1 for convenience in explanation, a washing machine 90' according to a second exemplary embodiment includes a part or all of a user interface 400, a display 410, a control device 420, a driving motor 430, and an actuator 440. The washing machine 90' may further include a part or all of a storage, a water level detector which detects a water level, a water supply valve, a water drainage valve, and the like.

Meanwhile, including a part or all of components signifies that a part of components, such as the user interface 400, is omitted or integrated with other components such as the display 410. Herein, it is described that the washing machine 90' includes all of the components for better understanding of the present disclosure.

The user interface 400 includes a button input unit which provides various user command for selecting a mode of the washing machine such as a washing mode, a spin-drying mode, a rinse-out mode, and the like. The washing machine 90' performs various operations in response to a user command by the user interface 400.

The display 410 displays a present operation state of the washing machine 90' which operates according to a user command. For doing this, the display 410 displays various state information. For example, the display 410 displays a state that a washing operation is in progress in a washing mode, or displays a remaining time of the washing operation.

The control device 420 controls overall operations of the inner components such as the user interface 400, the display 410, the driving motor 430, and the actuator 440 of the washing machine 90'. For example, when a user sets a washing mode through the user interface 400, the control device 420 may inform the user of the mode conversion through the display 440. In addition, the control device 420 may control the driving motor 430 together with the actuator 440 in order to perform the washing operation according to the set washing mode. In case of a spin-drying mode, the control device 420 may control only the driving motor 430. For example, the control device 420 may drive the actuator 440 to engage the coupling 144 with the rotation preventing unit 146 in order to perform the washing operation.

For example, the control device 420 according to an exemplary embodiment may include a control unit 420-1 which includes a microprocessor for controlling the washing machine 90' and a driving unit 420-2 which generates a control signal, that is, a control voltage according to control of the control unit 420-1, converts the generated control voltage, and transfers the control voltage to the driving motor 430. The driving unit 420-2, it will be described below in further details, divides and controls the driving motor 430 into a forced driving section and a speed control section according to the control of the control unit 420-1 in response to a mode being converted to the washing mode. In this case, an align section may be further included before the forced driving section. In addition, the driving unit 420-2 may further include an engagement detecting section for detecting an engagement of the clutch after the forced driving section.

For example, when a mode of the washing machine 90' is converted to the washing mode (or the washing mode starts), the driving unit 420-2 may perform an alignment operation of the clutch by rotating the driving motor 430 right and left according to the control of the control unit 420-1. Subsequently, the driving unit 420-2 performs a low-speed rotation operation by rotating the driving motor 430 right and left at a low speed with a high voltage in the forced driving section. In this case, the high voltage refers to a voltage which is higher than a voltage in the alignment operation. Subsequently, the driving unit 420-2 determines whether the coupling 144 of the clutch is correctly engaged with the rotation preventing unit 146 through the alignment operation and the low-speed rotation operation in the engagement detecting section. For doing this, the driving unit 420-2 rotates the driving motor 430 in a certain direction, stops the driving motor 430, and measures a stop time. In response to the stop time being in a predetermined range, the driving unit 420-2 determines that coupling 144 of the clutch was correctly engaged with the rotation preventing unit 146 and performs a washing operation. That is, the laundry agitation of the pulsator 130 is executed according to the speed control section of the driving unit 420-2.

The driving motor 430 and the actuator 440 are substantially the same as the driving motor 140-1 and the actuator 145 of FIG. 1, and thus, the detailed description will be omitted.

The storage may store a predetermined value for comparing the measured stop time. The water level detector includes a sensor, and thus, may sense a water level of the washing water which flowed into the water tank 110. The water supply valve and the water drainage valve include a switch, and thus, may operate according to the control of the control unit 420-1. Herein, the switch for operating the water supply valve and the water drainage valve may be included in the driving unit 420-2.

Figure 5:
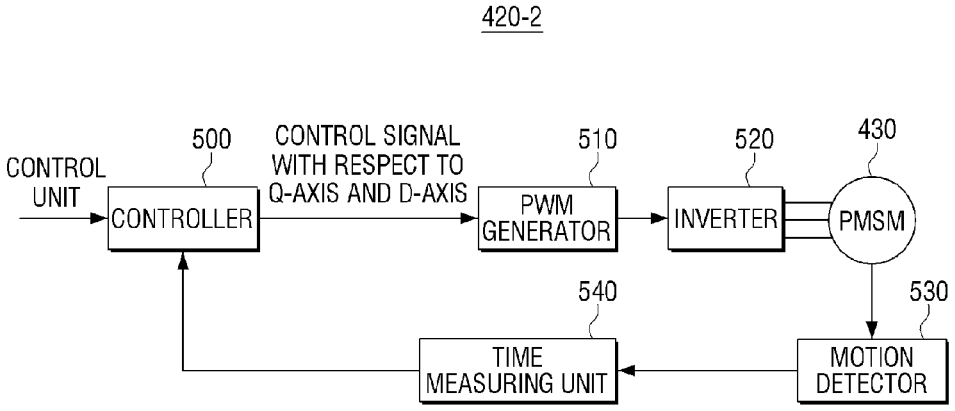
FIG. 5 is a block diagram illustrating structure of a driving unit of FIG. 4.
Figure 6:
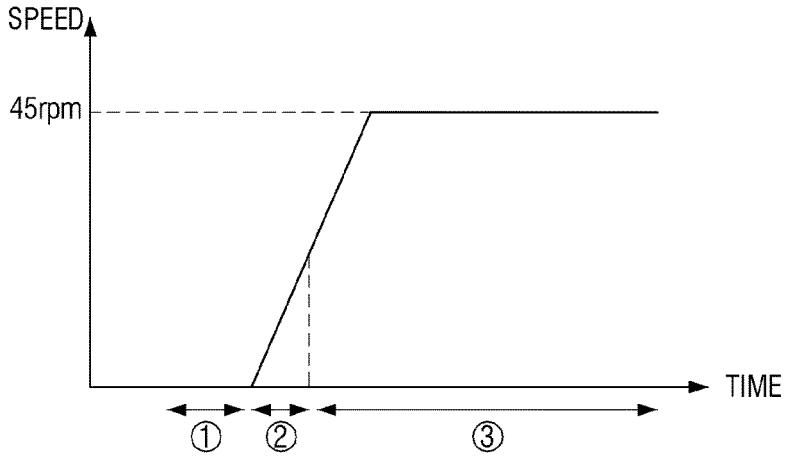
FIG. 6 is a view provided to describe a method of driving and controlling a motor according to an exemplary embodiment.
Figure 7:
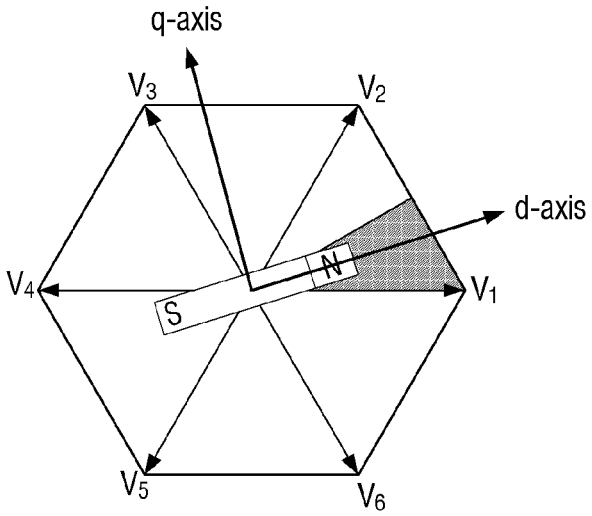
FIG. 7 is a view provided to describe a motor-control coordinate system according to an exemplary embodiment.

FIG. 5 is a block diagram illustrating structure of a driving unit of FIG. 4, FIG. 6 is a view provided to describe a method of driving and controlling a motor according to an exemplary embodiment, and FIG. 7 is a view provided to describe a motor-control coordinate system according to an exemplary embodiment Referring to FIG. 5 along with FIG. 4, the driving unit 420-2 of FIG. 4 according to an exemplary embodiment may include a part or all of a controller 500, a PWM generator 510, an inverter 520, a motion detector 530, and a time measuring unit 540. In addition, the driving unit 420-2 may further include a hall sensor 550 and a speed/location measuring unit 560.

Meanwhile, including a part or all of components signifies that a part of components, such as the controller 500, is omitted or integrated with other components such as the motion detector 530 and the time measuring unit 540. Herein, it is described that the driving unit 420-2 includes all of the components for better understanding of the present disclosure.

The controller 500 may operate with the control unit 420-1 of FIG. 4. For example, in response to the washing mode being selected by a user, related information may be provided to the controller 500. In this case, before performing the laundry agitation operation, the controller 500 performs a predetermined preliminary operation. Herein, the predetermined preliminary operation includes the horizontal clutch alignment operation, the low-speed rotation operation, and a clutch engagement detection operation. In order to perform the low-speed rotation operation, the controller 500 may generate a control signal for applying a q-axis voltage and a d-axis voltage to the stator 141 of the driving motor 430 and provide the PWM generator 510 with the generated control signal. That is, the controller 500 may provide information on a position angle (θ). In addition, the controller 500 may control a voltage for the alignment operation and a voltage for the low-speed rotation operation. Further, the controller 500 may control a speed, that is, an operating frequency. In case of a common motor, a rotational torque is generated in response to a voltage vector corresponding to a q-axis being applied. However, in the present exemplary embodiment, when a voltage vector corresponding to a d-axis is applied, a motor is aligned and stopped instead of being rotated. A low-speed rotation function is a function to move a position angle slowly in an align state so that the rotor 142 moves slowly.

In addition, the controller 500 receives a measurement result from the time measuring unit 540. In other words, the controller 500 receives a measurement result on a stop time of the driving motor 430 by the clutch engagement detection operation, determines whether to execute the laundry agitation operation or to execute the re-engagement operation based on the measurement result, and in response to determining that the measurement result relating to an error, generates an error.

The PWM generator 510 may generate a pulse signal according to the control of the controller 500 and generate voltages in different levels and signals in different pulse widths in order perform the alignment operation and the low-speed rotation operation. For example, the PWM generator 510 may generate a pulse signal using applied power voltages in different levels, and in this case, may generate a signal in various methods including a duty ratio adjustment, etc. In this case, in order to apply a plurality of voltages to the stator 141 of the driving motor 430, the PWM generator 510 may operate a plurality of pulse generators. Such operation may be performed in various methods, and thus, the detailed description will be omitted.

The inverter 520 may convert a pulse signal to an alternating current and may provide the driving motor 430 with a voltage obtained by adding applied three-phase voltage. According to the exemplary embodiment, the inverter 520 may include a plurality of inverters 520 in order to respectively apply voltages to the stators 141 of the driving motor, which correspond to the q-axis and the d-axis.

The motion detector 530 monitors the clutch engagement detection operation. In other words, the motion detector 530 test-operates the driving motor 430 so as to be rotated in a certain direction, stops the driving motor 430, and determines whether the driving motor 430 is stopped. Further, the motion detector 530 may provide the time measuring unit 540 with a time value when the driving motor 430 is stopped.

The time measuring unit 540 may have a predetermined value regarding a stop time and may compare the predetermined value with a value of a stop time provided by the motion detector 530. For example, in response to the value of the stop time being in a range of the predetermined value, the time measuring unit 540 may determine that the an engagement operation was correctly performed and inform the controller 500 of the state. In response to the value of the stop time exceeding the range of the predetermined value, the time measuring unit 540 may determine that an engagement operation was incorrectly performed and inform the controller 500 of the state.

Based on the above-described components, the driving unit 420-2 of FIG. 4 performs the low-speed rotation operation and the engagement detection operation according to the exemplary embodiment, and further performs the horizontal alignment operation. In this case, the driving unit 420-2 may operate with the control unit 420-1.

Meanwhile, the driving unit 420-2 according to the exemplary embodiment may further include a hall sensor which senses a rotation of the driving motor 430 and a location/speed measuring unit which measures a location and a speed of the driving motor 430 using a signal of the hall sensor.

For example, as illustrated in FIG. 5 and FIG. 6, the driving motor 430 may be divided into the forced driving section and the speed control section for rotation. In this case, in order to rotate the driving motor 430, information on a speed and location of the driving motor 430 is required. However, the driving motor 430 is stopped at an initial stage, and thus, information through the hall sensor cannot be obtained. Thus, the driving motor 430 is rotated forcibly at the initial stage, and when a signal of the hall sensor is generated in response to the rotation of the driving motor 430, the speed control may be performed using the hall sensor at that time.

Figure 8:
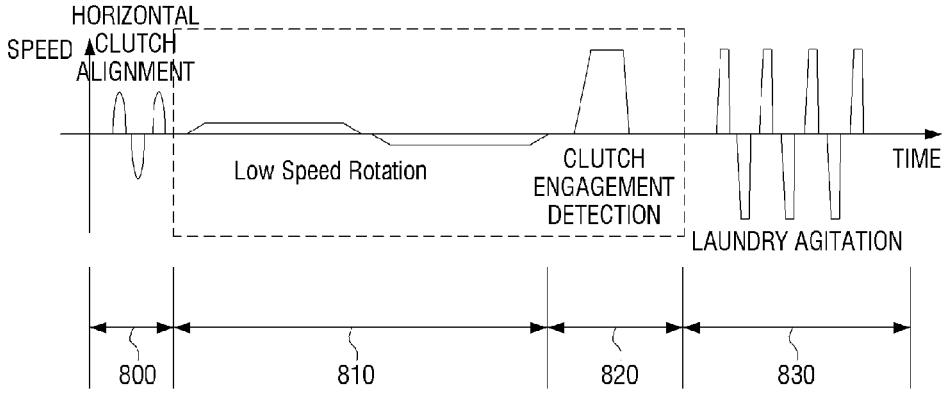
FIG. 8 is a view provided to describe a clutch-control profile according to an exemplary embodiment.

Meanwhile, FIG. 8 illustrates a coordinate system according to a location of a rotor. When a part where a north (N) polar of the rotor is located is set to be a d-axis and a part which is led by 90 degrees is set to be a q-axis, in order to rotate the driving motor 430, a voltage is supplied to the stator 141 so that a magnetic field is formed on the q-axis, and the rotor 142 is rotated in a direction of the q-axis.

The clutch horizontal alignment is a function to facilitate the clutch engagement by rotating the driving motor 430 for a certain period of time, and there are some respects to be considered according to a size of a laundry load. With the small quantity of laundries, the rotation of the driving motor 430 is performed without any problems, but with the large quantity of laundries, a voltage to be applied to the driving motor 430 needs to be raised. However, in this case, noises occur in the horizontal clutch alignment operation, and thus, the voltage needs to be set as low as possible so as not to raise the noises. Thus, when there is a large laundry load, the driving motor 430 is not rotated, and thus, the horizontal clutch alignment operation is not performed normally.

In order to resolve such problem, the low-speed rotation operation is provided in the present exemplary embodiment. The low-speed rotation operation is an operation which supplies a voltage so that a magnetic field is formed on the d-axis as illustrated in FIG. 7. In response to the magnetic field being formed on the d-axis, the driving motor 430 is stopped, not rotated. This operation may be called 'driving motor alignment.' The motor alignment may be executed in a desired position within an angle range between 0 to 360 degrees. When a position angle is adjusted slowly while the motor alignment is performed, the rotor 142 moves slowly to a predetermined position angle. Slowly adjusting the position angle signifies that the controller 500 makes and use a position angle according to a predetermined frequency without using the hall sensor of the driving motor 430, and in this case, the driving motor 430 may be rotated at a certain speed at all times. The rotor 142 moves slowly even though a high level of voltage is supplied, and thus, any noise does not occur. Thus, it is possible to slowly rotate the driving motor 430 regardless of the size of the laundry load.

Figure 9:
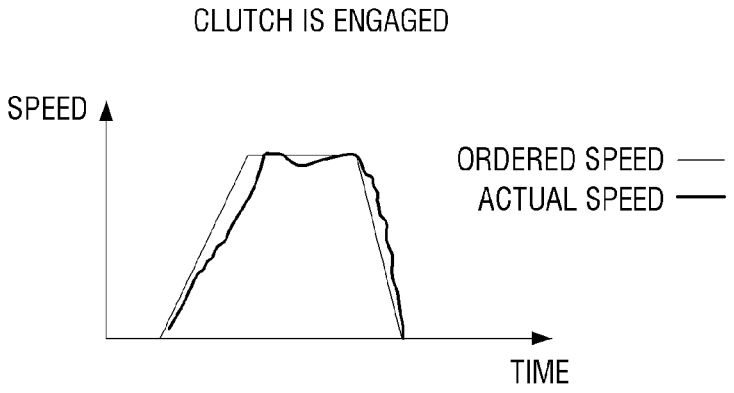
FIG. 9 is a view provided to describe a speed profile when a clutch engagement is detected, according to an exemplary embodiment.
Figure 9:
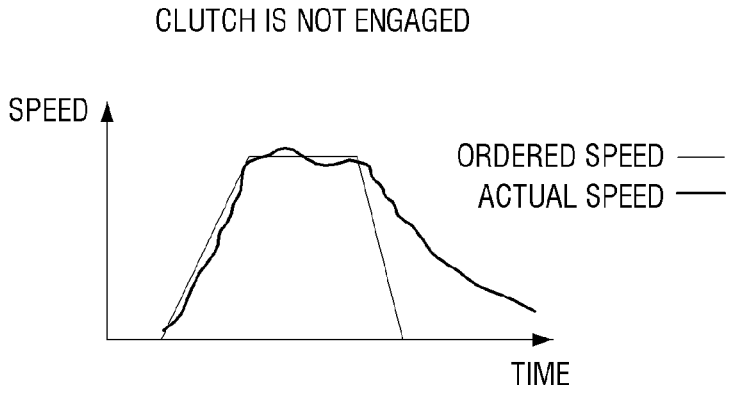
Figure 10:
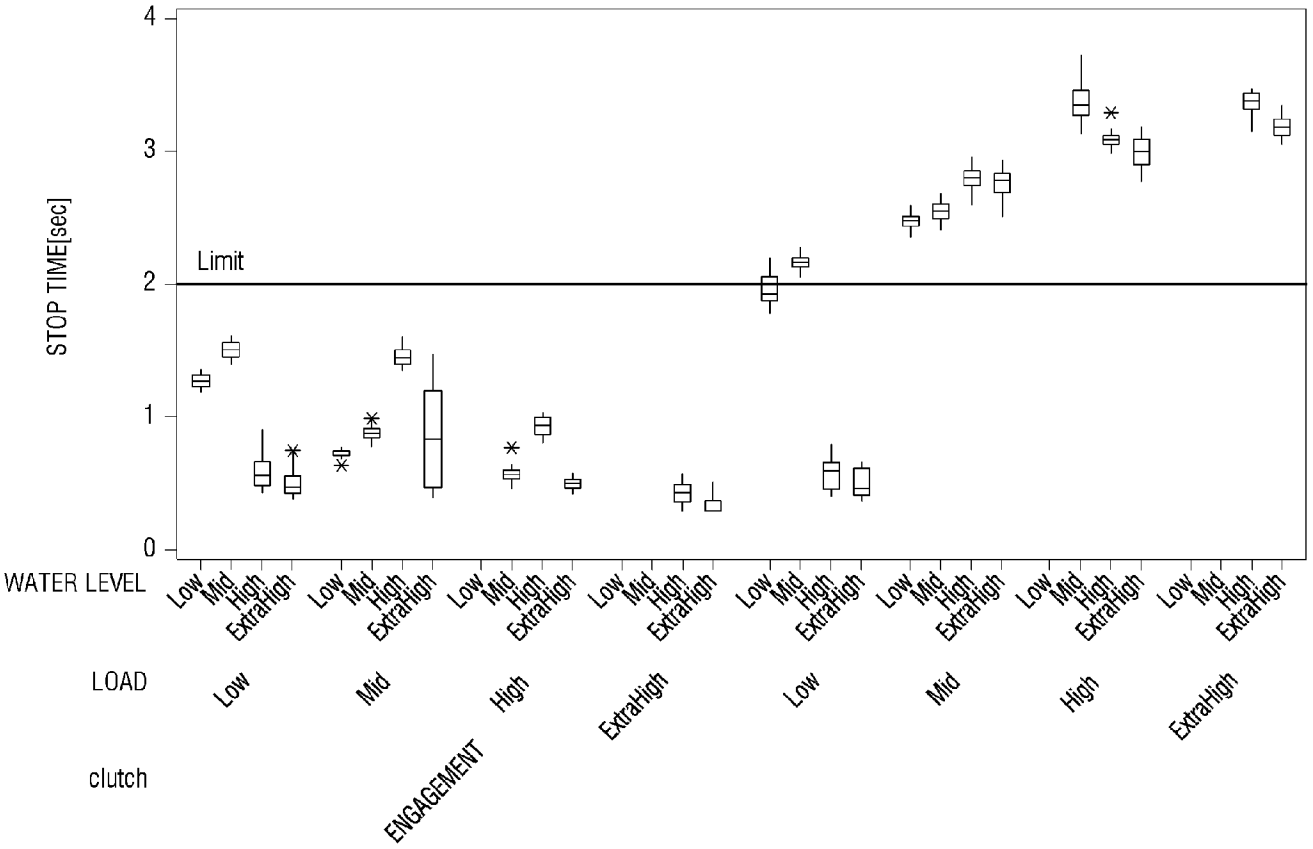
FIG. 10 is a view illustrating an example of clutch engagement detection data for respective loads according to an exemplary embodiment.

FIG. 8 is a view provided to describe a clutch-control profile according to an exemplary embodiment, FIG. 9 is a view provided to describe a speed profile when a clutch engagement is detected, according to an exemplary embodiment, and FIG. 10 is a view illustrating an example of clutch engagement detection data for respective loads according to an exemplary embodiment.

Referring to FIGS. 8 to 10 along with FIG. 1 for convenience in explanation, when the washing machine 90 according to the exemplary embodiment has the large laundry load, the clutch engagement may not be performed by the horizontal clutch alignment operation which is executed in a clutch horizontal alignment section 800 alone.

Accordingly, in the present exemplary embodiment, the low-speed rotation operation which is executed in a low-speed rotation section 810 is provided. Herein, the low-speed rotation refers to a function of assisting the clutch engagement with forcibly rotating the driving motor 140-1 at a low speed so that a strong torque is not applied to a clutch tooth. According to the exemplary embodiment, in an experiment of rotating the driving motor 140-1 once to the left for one second with 3 rpm and once to the right for one second with 3 rpm, the clutches are engagement is performed 100% through the low-speed rotation operation. According to an exemplary embodiment, a clutch engagement detection operation performed in a clutch engagement detection section 820 is added after the low-speed rotation operation. In response to the clutch engagement being performed normally, the washing machine 90 executes the laundry agitation in a laundry agitation section 830.

According to an exemplary embodiment, as described above, the washing machine 90 performs the clutch engagement detection operation after the low-speed rotation operation. Such clutch engagement detection operation is performed by measuring a stop time when the driving motor 140-1 is rotated and stopped. In the present exemplary embodiment, in an experiment of measuring a stop time by turning on the driving motor 140-1 for one second with 100 rpm and turning off the driving motor 140-1 for four seconds, as illustrated in FIG. 9A, the stop time is short when the clutch engagement is correctly performed, but when the clutch engagement is incorrectly performed, the stop time increases since the washing spindle 150 and the spin-drying spindle 160 are not separated, and thus, the spin-drying spindle 160 is rotated.

In addition, according to an exemplary embodiment, in an experiment of measuring a stop time by respective water levels/loads which is performed to analyze an effect of the clutch engagement detection operation, as illustrated in FIG. 10, any misdetection does not occur in the entire load/water level conditions when the clutch engagement is correctly performed. However, when the clutch engagement is incorrectly performed, misdetections occurs in the conditions where the load is above the medium level.

Figure 11:
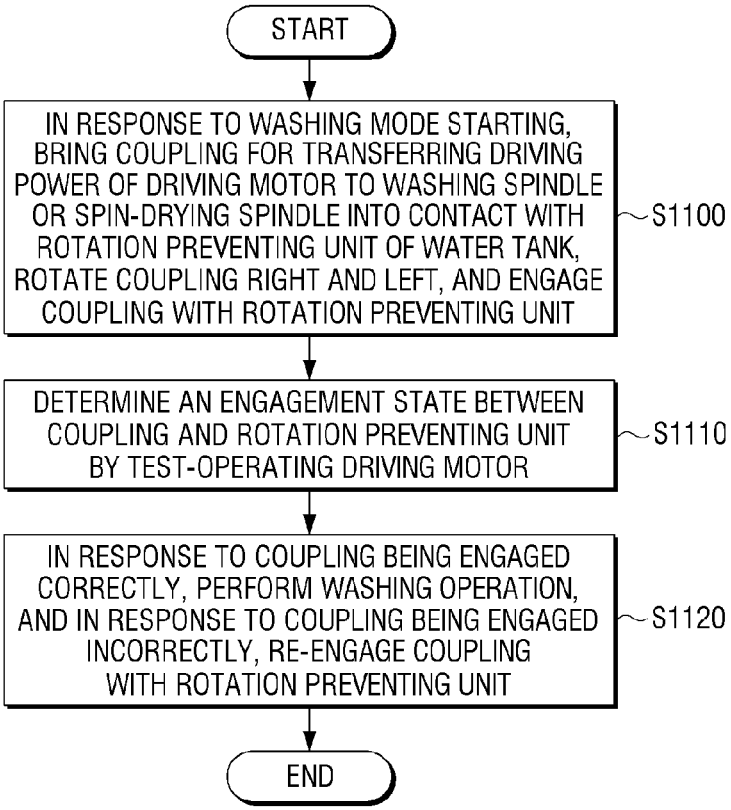
FIG. 11 is a flowchart provided to describe a process of controlling a washing machine according to the first exemplary embodiment.

FIG. 11 is a flowchart provided to describe a process of controlling a washing machine according to the first exemplary embodiment.

Referring to FIG. 11 along with FIG. 1 for convenience in explanation, the washing machine 90 according to the exemplary embodiment rotates the driving motor 140-1 right and left at a certain speed and voltage, and engages the coupling 144 with the rotation preventing unit 146 of the water tank 110 in the washing mode.

In other words, in response to the washing mode starting, the washing machine 90 brings the coupling 144 into contact with the rotation preventing unit 146 of the water tank 110, rotates the coupling right and left, and engages the coupling 144 with the rotation preventing unit 146 (S1100).

Subsequently, the washing machine 90 controls the driving unit 140 which is equipped with the coupling 144 based on a measurement result of a stop time when the driving motor 140-1 is rotated and stopped. Herein, controlling the driving unit 140 signifies that the washing operation is executed when it is determined that the coupling engagement is correctly performed. When it is determined that the coupling engagement is incorrectly performed, the engagement operation is re-executed.

In further details, the washing machine 90 determines an engagement state between the coupling 144 and the rotation preventing unit 146 by test-operating the driving motor 140-1 (S1110). In this case, test-operating refers to the low-speed rotation operation, and the driving motor 140-1 may be forcibly rotated in a certain direction.

In response to the coupling 144 being engaged correctly, the washing machine 90 performs a washing operation, and in response to the coupling 144 being engaged incorrectly, re-engages the coupling 144 with the rotation preventing unit (S1120).

Figure 12:
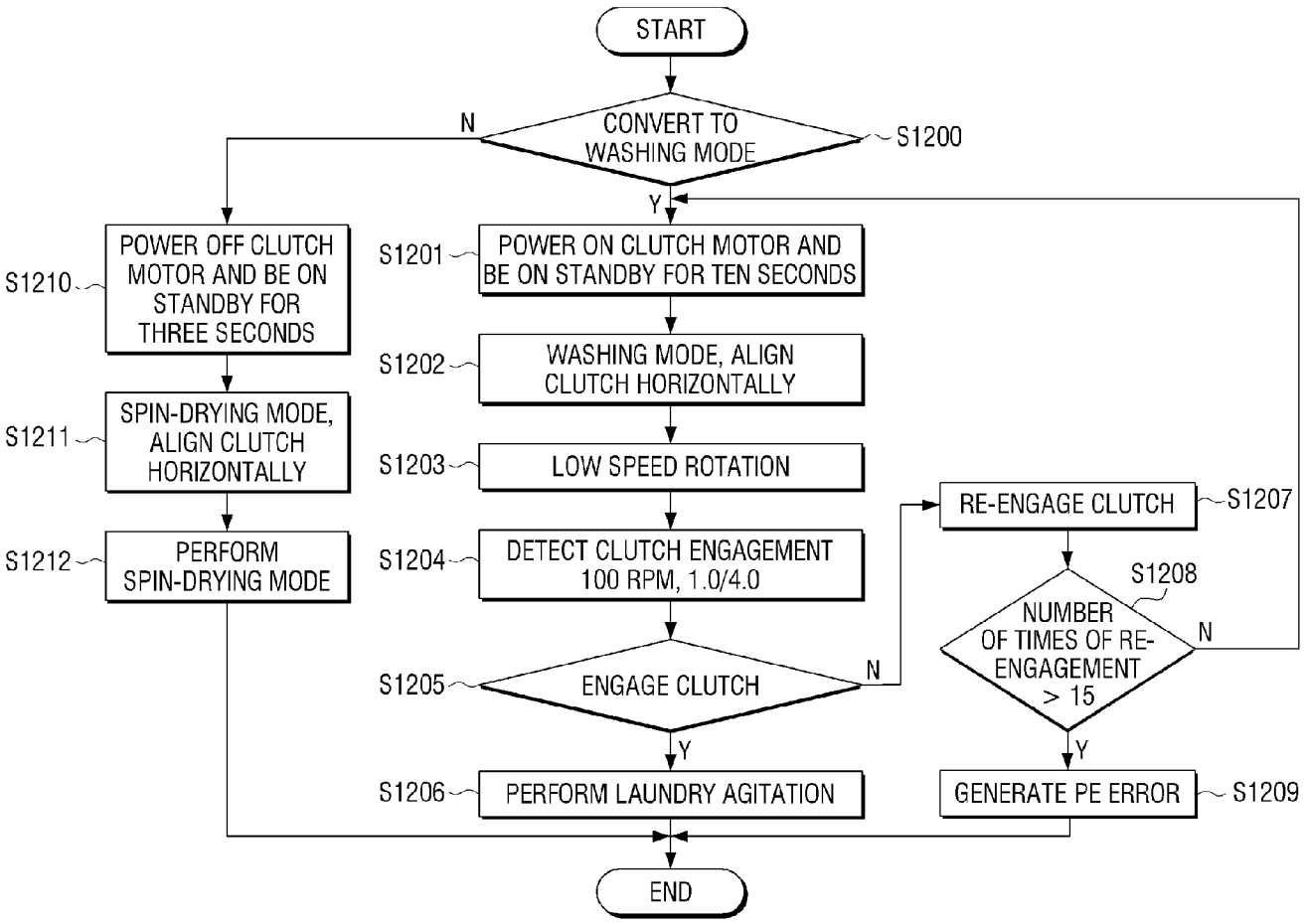
FIG. 12 is a flowchart provided to describe a process of controlling a washing machine according to the second exemplary embodiment.

FIG. 12 is a flowchart provided to describe a process of controlling a washing machine according to the second exemplary embodiment.

Referring to FIG. 12 along with FIG. 1 for convenience in explanation, the washing machine 90 according to the exemplary embodiment determines whether a mode of the washing machine is converted to a washing mode (or the washing mode starts) (S1200).

In response to determining that the mode being converted to the washing mode, the washing machine proceeds with the washing mode. Alternatively, the washing mode may proceed with a spin-drying mode.

In response to determining that the mode being converted to the washing mode, the washing machine 90 applies power for driving the driving motor 140-1 and is on standby for several seconds (S1201). This operation is to wait until the power is applied and an stabilization process starts.

Subsequently, as described above, the washing machine 90 may perform the horizontal clutch alignment operation, the low-speed rotation operation, and the engagement detection operation (S1202, S1203, S1204). In this case, the horizontal clutch alignment operation may omitted. The specific operations were described above, and thus, the detailed description will be omitted.

The engagement detection operation of the washing machine 90 includes a process of measuring a stop time of the driving motor 140-1 (S1204) and a process of determining whether the engagement is correctly performed or not based on a measurement result of the stop time (S1205). In this case, the determining operation is performed by comparing a value of the measured stop time with a value which is prestored in a memory and determining the engagement based on a result of comparison. For doing this, whether the comparison result goes beyond a predetermined range may be determined.

In response to determining that the engagement was correctly performed, the washing agitation operation is performed (S1206). In response to determining that the engagement was incorrectly performed, the washing machine 90 re-executes the clutch engagement operation (S1207).

When the incorrect engagement state is changed to a normal state within a certain number of times as the result of the re-execution, the process returns to S1201. However, when the number of times of the re-execution exceeds fifteen times, a parity error may be generated to inform a user of malfunction (S1209).

In case of a spin-drying mode, the washing machine 90 may turn off the driving motor 140-1 and be on standby for a certain period of time, for example, three seconds (S1210).

Subsequently, in the same manner as in the washing mode, the washing machine 90 performs the horizontal clutch alignment operation (S1211).

Then, the washing machine 90 proceeds with the spin-drying mode (S1212).

As above, the operation that the washing machine 90 of FIG. 1 performs the clutch engagement detection operation only when a mode of the washing machine is converted to the washing mode was described with reference to FIGS. 1 to 12. However, when the clutch engagement is not correctly performed in the washing mode, the stop time of the driving motor 140-1 may increase. Thus, in the following exemplary embodiments, the clutch engagement detection operation performed in entire sections of the washing operation will be described with reference to FIGS. 13 to 15.

Figure 13:
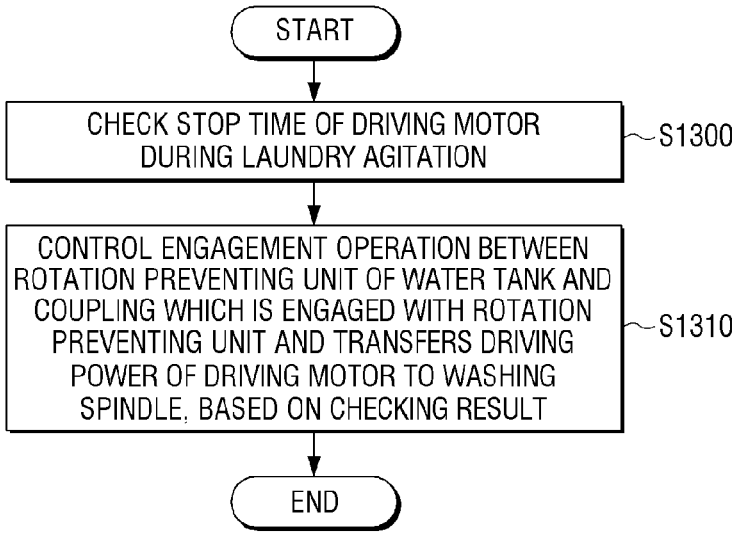
FIG. 13 is a flowchart provided to describe a process of controlling a washing machine according to a third exemplary embodiment.

FIG. 13 is a flowchart provided to describe a process of controlling a washing machine according to a third exemplary embodiment.

Referring to FIG. 13 along with FIG. 1 for convenience in explanation, according to another exemplary embodiment, the washing machine 90 checks a stop time of the driving motor 140-1 during the laundry agitation (S1300). That is, the washing machine 90 may rotate the washing spindle 150 using the driving motor 140-1 and may measure a stop time with respect to a rotation in a certain direction while the washing spindle 150 is rotated right and left. For example, when a laundry time lasts for fifteen minutes, the washing machine 90 may check the stop time at an interval of a certain time, that is, five minutes.

Subsequently, the washing machine 90 controls an engagement operation between the rotation preventing unit 146 of the water tank 110 and the coupling 144, which is engaged with the rotation preventing unit 146 and transfers the driving power of the driving motor 140-1 to the washing spindle 150, based on the checking result (S1310).

For example, when the engagement operation is incorrectly performed, the washing machine 90 may re-execute the engagement operation. Or, when the number of times of the re-execution exceeding a predetermined number of times, the washing machine 90 may convert the mode to the spin-drying mode for a while and return to the washing mode.

Figure 14:
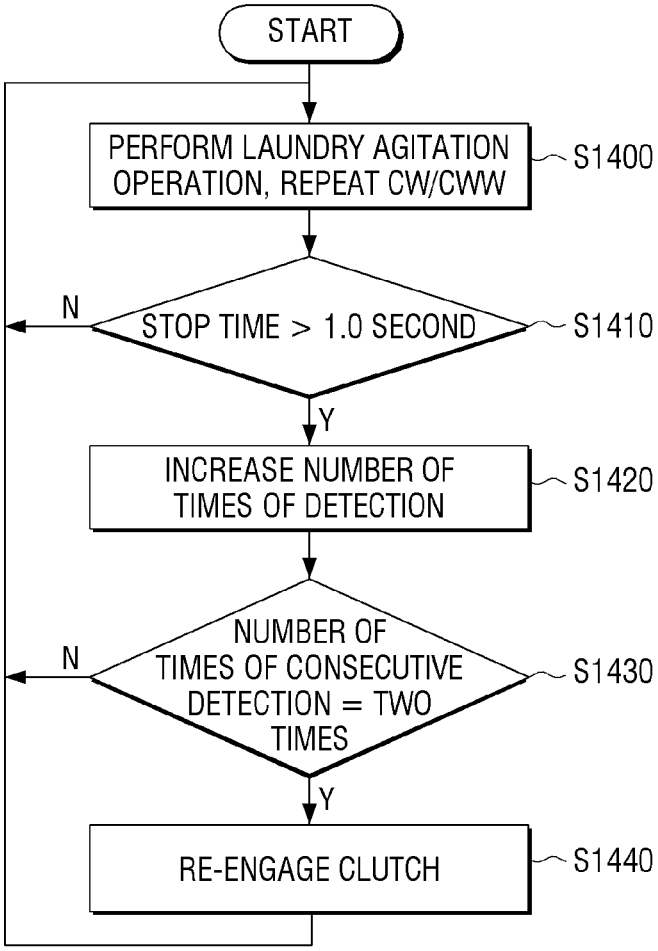
FIG. 14 is a flowchart provided to describe a process of controlling a washing machine according to a fourth exemplary embodiment.
Figure 15:
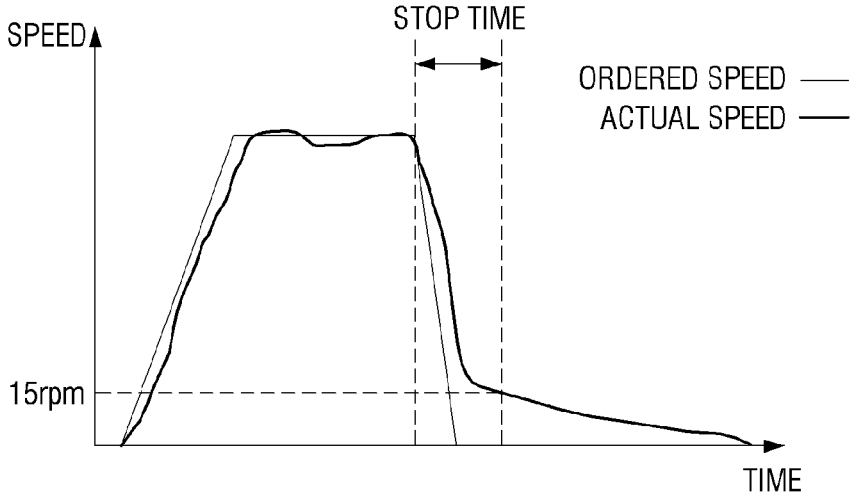
FIG. 15 is a view provided to describe measurement of a stop time during washing agitation.
Figure 16:
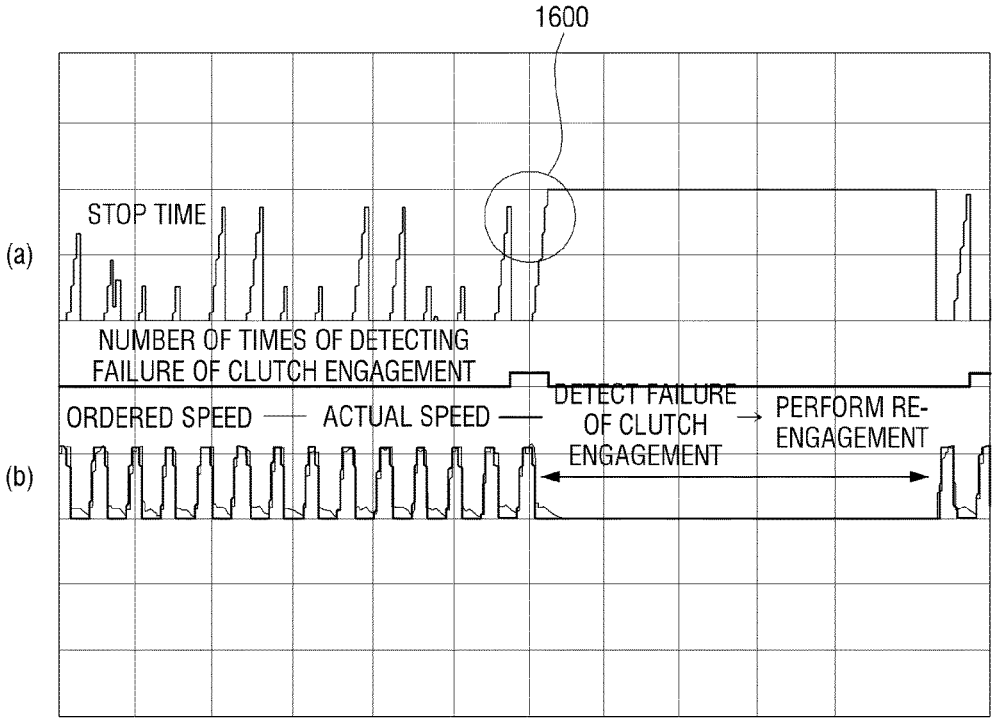
FIG. 16 is a view provided to describe a washing operation profile during the washing agitation.

FIG. 14 is a flowchart provided to describe a process of controlling a washing machine according to a fourth exemplary embodiment, FIG. 15 is a view provided to describe measurement of a stop time during washing agitation, and FIG. 16 is a view provided to describe a washing operation profile during the washing agitation.

Referring to FIG. 14 along with FIG. 1 for convenience in explanation, according to another exemplary embodiment, the washing machine 90 performs a laundry agitation operation according to a progress of the washing mode (S1400).

Subsequently, the washing machine 90 may check a stop time of the driving motor 140-1 during the laundry agitation operation, as illustrated in FIG. 14 (S1410).

In response to the stop time exceeding one second as illustrated in FIG. 14, for example, the washing machine 90 may increase the number of times of detection and check the stop time once more (S1420).

In response to determining that the stop time exceeds one second two consecutive times, the washing machine 90 determines that the clutch 143, 144, 146 is not engaged (S1430, S1440).

In response to the clutch not being engaged, the washing machine 90 may re-execute the engagement operation.

For example, as illustrated in FIG. 16A, when the stop time of the driving motor 140-1 is checked while the laundry agitation operation is performed according to the washing operation and it is determined that the stop time exceeds one second two consecutive times in a section corresponding to Reference numeral 1600, the washing machine 90 may determine that the clutch 143, 144, 146 is not engaged and re-execute the engagement operation.

In the above process, the failure of the clutch engagement in the washing mode may occur due to defect of the stator of the driving motor 140-1, and thus, in this case, the washing machine 90 may convert the mode to the spin-drying mode, rotate the spin-drying tub 120 for one second, convert the mode to the washing mode again, and determine whether the clutch is correctly engaged.

Meanwhile, although it has been described that entire components constituting the exemplary embodiments of the present disclosure are combined as a single component or operate by being combined with each other, the exemplary embodiments are not limited thereto. That is, unless it goes beyond the purpose of the exemplary embodiments, the entire components may be selectively combined as one or more components. In addition, each of the entire components may be implemented as independent hardware. Alternatively, a part or all of the components may be selectively combined and implemented as a computer program having a program module which performs a part or all functions combined in one or a plurality of pieces of hardware. Codes and code segments constituting the computer program may be easily derived by a person having ordinary skill in the art. The computer program may be stored in a non-transitory computer readable recording medium and read and executed by a computer thereby implementing the exemplary embodiments of the present disclosure.

The non-transitory computer readable recording medium refers to a medium which may store data permanently or semi-permanently rather than storing data for a short time such as a register, a cache, and a memory and may be readable by an apparatus. As an example, the above-described various applications and programs may be stored in the non-transitory computer readable recording medium such as a compact disc (CD), a digital versatile disk (DVD), a hard disk, a Blu-ray disk, a universal serial bus (USB), a memory card, a read-only memory (ROM), and the like, and provided therein.

The foregoing embodiments and advantages are merely exemplary and are not to be construed as limiting the present invention. The present teaching can be readily applied to other types of apparatuses. Also, the description of the exemplary embodiments of the present inventive concept is intended to be illustrative, and not to limit the scope of the claims, and many alternatives, modifications, and variations will be apparent to those skilled in the art.

What is claimed is:

1. A washing machine comprising:

a washing spindle connected to a pulsator;

a spin-drying spindle connected to a spin-drying tub;

a driving motor having a stator and a rotor and being configured to generate a driving power;

a coupling member configured to selectively transfer the driving power to the spin-drying spindle according to a position of the coupling member;

an actuator configured to move the coupling member; and a control device configured to operate the actuator to move the coupling member to prevent the driving power from transferring to the spin-drying spindle, in response to operating the actuator to move the coupling member to prevent the driving power from transferring to the spin-drying spindle, operate the driving motor to rotate the washing spindle in a first direction at a first speed and then to rotate the washing spindle in a second direction at the first speed, and after operating the driving motor to rotate the washing spindle in the second direction at the first speed, measure a time taken from when the driving motor rotates at a second speed to when the driving motor stops, wherein the second speed is greater than the first speed.

2. A washing machine comprising:

a washing spindle connected to a pulsator;

a spin-drying spindle connected to a spin-drying tub;

a driving motor having a stator and a rotor and being configured to generate a driving power;

a coupling member configured to selectively transfer the driving power to the spin-drying spindle according to a position of the coupling member;

an actuator configured to move the coupling member; and a control device configured to control the actuator to move the coupling member to prevent the driving power from transferring to the spin-drying spindle, control the driving motor to apply a first voltage to the stator to rotate the washing spindle in a first direction and a second direction at a first speed, and control the driving motor to apply a second voltage to the stator where a north (N) pole of the rotor is located to rotate the washing spindle in the first direction and the second direction at a second speed, wherein the second speed is lower than the first speed, and the second voltage is higher than the first voltage.

* * * * *